United States Patent [19]

Bekiaroglou

[11] Patent Number: 4,553,506

[45] Date of Patent: Nov. 19, 1985

[54] ENGINE WITH ROTATING CYLINDER WALL

[76] Inventor: Prodromos Bekiaroglou, Karl-Theodorestrasse 54/IV, 8000 München 40, Fed. Rep. of Germany

[21] Appl. No.: 503,192

[22] PCT Filed: Sep. 23, 1982

[86] PCT No.: PCT/EP82/00213

§ 371 Date: May 18, 1983

§ 102(e) Date: May 18, 1983

[87] PCT Pub. No.: WO83/01088

PCT Pub. Date: Mar. 31, 1983

[30] Foreign Application Priority Data

Sep. 23, 1981 [GR] Greece ..... 66123
Jun. 30, 1982 [DE] Fed. Rep. of Germany ..... 3224482

[51] Int. Cl.[4] ..... F02B 75/28
[52] U.S. Cl. ..... 123/45 R; 92/31
[58] Field of Search ..... 123/45 A, 45 R; 92/31; 74/56, 57, 22 R

[56] References Cited

U.S. PATENT DOCUMENTS 1,513,302 10/1924 Wahlstrom ..... 92/31
3,477,345 11/1969 Johnson ..... 92/31
4,136,647 1/1979 Stoler ..... 123/45 R
4,180,028 12/1979 Richter ..... 123/45 A

FOREIGN PATENT DOCUMENTS 2514480 10/1975 Fed. Rep. of Germany .... 123/45 R

*Primary Examiner*—Michael Koczo
*Assistant Examiner*—John McGlew, Jr.
*Attorney, Agent, or Firm*—Sprung Horn Kramer & Woods

[57] ABSTRACT

This invention refers to a piston machine, most particularly an internal-combustion machine, in which the cylinder wall performs a rotating motion round its own axis. Apertures on the cylinder wall allow it to act as a rotating slide valve, so that no valve system is needed. In the first example, the stroke movement of the piston is converted to the rotating motion of the cylinder wall (which on the same time serves as the axle of the machine) through bolts which slide or roll in linear guide-slits in the cylinder wall and curved guide-tracks on the stationary outer part of the machine. The use of the curved guide-tracks allows the adaptation of the time-law for the volume change in the working chamber, to the needs of the mechanics, thermodynamics and reaction kinetics. In the same rotating cylinder are installed two pistons of equal mass which fulfil an exactly symmetrical opposite motion, so that no free accelerating forces exist and therefore no vibrations appear on the machine. In the second example the stroke movement of the piston is converted to the rotating motion of the axle through a crank and two universal joints. The relative position of the axis of the crank and the axis of the cylinder determine the length of the stroke and in consequence its power. The crank's bearing position can vary correspondingly to the cylinder during the function of the machine, so that its power is continuously variable and even its working direction can be reversed without stopping and by constant rotating speed.

5 Claims, 16 Drawing Figures

ENGINE WITH ROTATING CYLINDER WALL

BACKGROUND OF THE INVENTION

This invention relates to a machine with an inside space (working chamber) which periodically changes its volume and more particularly refers to a machine that is mainly used as a power engine, as pump for liquids and gases or as a compressor for gases.

Such machines commonly use for their operation the stroke movement of a cylindrical piston in a cylindrical hole. The linear motion of the piston is converted to the rotating motion needed for most purpose with a mechanism consisting of a connecting rod and crankshaft. The motion of additional parts (valves) is needed to open and close the working chamber for the inlet and outlet of the operating fluid. A separate mechanism is required for this purpose.

The advantage of such constructions is mainly that the cylindrical working chamber can be sealed easily and efficiently. Furthermore these machines have been built for decades and reached a high degree of sophistication through a process of continual improvement.

Their most notable disadvantages are:

1. The mechanism for the motion of the valves impedes (on account of its inertia) the quick inlet and outlet of the working medium and moreover is complicated, expensive and delicate.

2. The time-law for the change of the volume in the working chamber is not the best one either for diminishing the accelerating forces, nor for increasing the efficiency of the machine, but it cannot be changed since it is imposed on account of the kinetic principle of the crankshaft.

3. During the conversion of the linear movement to the rotational movement strong oblique forces appear on the piston that cause great friction losses and wear.

4. The length of the stroke of the piston remains constant and subsequently the power of the engine, at constant rotational speed. Therefore a supplementary gear box is needed for most applications.

Numerous attempts to escape from these disadvantages have been undertaken and are being continuously carried out, but they are confronted with other difficulties like problems of construction, sealing and wear; or they cause reduction of efficiency.

SUMMARY OF THE INVENTION

The aim of this invention is the construction of a machine which with the greatest possible simplicity fulfils the function of a piston engine without the disadvantages of the known types.

I have found that the above object may be accomplished by giving to the cylinder wall and/or cylinder top a rotating motion around its own axis. This motion is used to regulate the inlet and outlet to the chamber. Connecting opening or openings (muzzles) on the cylinder wall and/or cylinder top meet (during the rotation) on the facing stationary part of the engine:

(a) Channels for the inlet or outlet of the working fluid (the chamber is open, depending on the direction of the piston's movement, outlet succeeds intake) or (b) the closed wall (the chamber is closed, depending on the piston's movement, there is compression or expansion) or (c) devices for an additional inlet of a fluid (e.g. injection jet) or ignition (e.g. spark plug).

BRIEF DESCRIPTION OF THE DRAWINGS

In FIG. 2*b* the cylinder is rotated 90° with regard to FIG. 2*a;*

FIGS. 7*a* and 7*b* are perspective views and FIG. 7*c* is a partial cross-sectional view;

FIGS. 8*a* and 8*b* show guide means for converting the linear motion of piston into the rotating motion of the piston- and -cylinder assembly;

FIG. 9*b* is a cross-section view along the line b—b of FIG. 9*a,* wherein a stationary member has a linear guide disposed therein.

DETAILED DESCRIPTION OF THE INVENTION

Figures 1A, 1B, 1C, 1D, 1E:
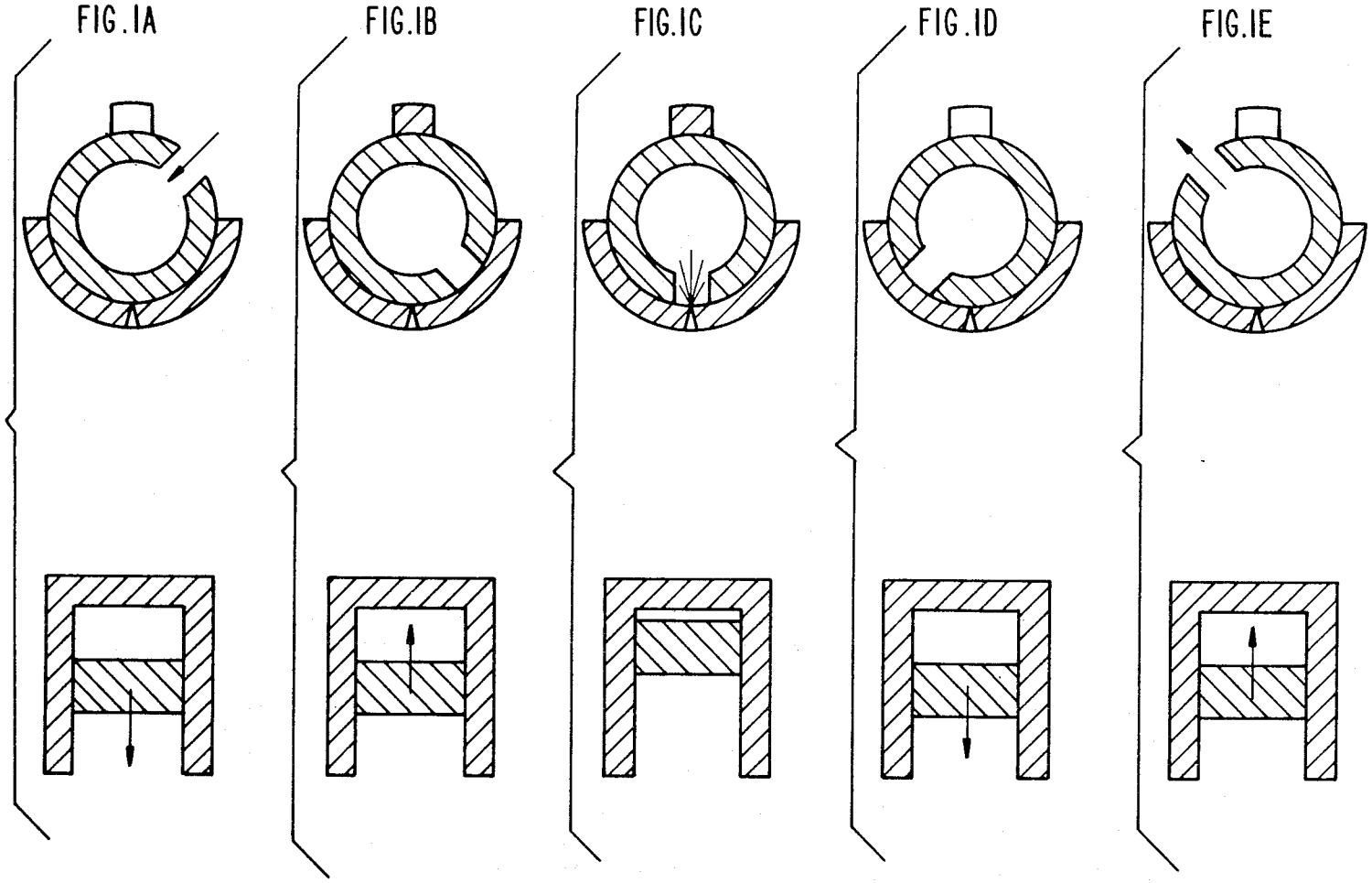
FIG. 1 depicts cross-sectional elevational views, wherein the upper row shows the different positions of the connecting opening and the lower row shows the corresponding positions of the piston in a four stroke engine in accordance with the present invention. In position (a), the muzzle is lined up with the inlet channel, the piston's movement causes an increase of the chamber's volume and is allowed to stream in. In position (b), the closed wall of the immobile outer part of the engine is in front of the connecting opening, the chamber is shut, the piston's movement causes compression. In position (c), the piston reaches its highest point, the muzzle is in front of the spark plug, ignition takes place. In position (d), the chamber is closed, expansion occurs. In position (e) the gas flows out.

FIG. 1 shows these possibilities on the principle of a four stroke engine. The upper row indicates the different positions of the connecting opening, the lower row the corresponding positions of the piston. In position (a) the muzzle is lined up with the inlet channel, the piston's movement causes the increase of the chamber's volume, gas streams in. In position (b) the closed wall of the immobile outer part of the engine stands in front of the connecting opening, the chamber is shut up, the piston's movement causes compression. In position (c) the piston has reached its highest point, the muzzle is in front of the spark plug, ignition takes place. In position (d) the chamber is closed, expansion occurs. In position (e) the gas flows out.

The piston maintains its cylindrical form so that it can be easily sealed with piston rings and can fulfil a pure stroke movement or have an additional rotating motion around his own axis with the same or another angular velocity as the cylinder wall.

The sealing of the connecting openings against the immobile outer part of the engine is achieved through one or more concentric sealing rings put around the muzzles of the cylinder wall and/or cylinder top. These rings have a round, oval or polygon shape accordingly to the form of the muzzle. The rings are pressed against the stationary part of the engine through self elasticity or by springs installed underneath.

Another possibility to seal the connecting opening against the stationary part is to put the sealing rings (like the piston rings) over the whole periphery of the rotating cylinder wall in both sides of the connecting opening, while the space between them is tightened with sealing sticks or rolls parallel to the cylinder axis.

The sealing elements can also be installed, instead of the outer side of the rotating cylinder wall, in the inside of the stationary part of the machine. In that case they must surround all the openings of this part (inlet channel, outlet channel, devices for additional inlet and ignitiion), or they must lie over the whole periphery in both sides of these openings.

The main advantage of this invention lies in the fact that: Although the cylindrical form of the piston and the four-stroke principle have been maintained, the engine is relieved from the valve mechanism. Consequently the invention reduces the construction and repair cost as well as the engine's volume and weight. Furthermore the flow conditions are improved, because the opening and closing of the chamber proceeds faster since there is no need to accelerate any additional masses and the whole cross section of the connecting opening is available to the flow of the working medium. Additional advantages depend on the use of the engine, the engine specifications, and foremost on the manner in which the stroke of the piston is realized. If the conventional mechanism of the crankshaft is used, this case dispenses with detailed description. But if one desires to be relieved from the disadvantages (page 1 points 2 and 3) which the crankshaft mechanism has in addition to its large weight and volume; or if a variable power option is pursued, I have invented constructions which bring the advantages of this invention to its full validity. In two examples herebelow such constructions are described in detail.

EXAMPLE 1

FIGS. 2(*a* and *b*) show an internal-combustion engine with four chambers in a common cylinder 1 which at the same time is the axle of the machine. The double pistons 2 and 3 form the four chambers 4, 5, 6 and 7. The curved guides 8 and 9 are built like grooves in the stationary outer part. In these grooves slide the ends of the bolts 10 and 11 which are fixed on to the pistons. The bolts penetrate the cylinder wall through the slits 12 and 13. When the cylinder rotates, the slits force the bolts 10 and 11 (and consequently the pistons) to rotate too. During this motion however, the bolts must follow the guidance of the grooves 8 and 9 and therefore they result in a linear axial movement, which is furthered on the pistons.

Axial (or combined axial-radial) bearings in both ends of the rotor carry the strong axial forces caused by the pressure in the working chamber. The minor radial forces resulting from the weight of the rotor are mainly distributed to the four gliding surfaces on which slide the cylinder muzzles. Therefore at these locations one must have sliding bearings or needle bearings. Lubricant is put in the space where the bolts 10 and 11 are moving. Cooling medium (water, air or oil) circulates round the rotor. Sealing rings on the proper positions separate the lubricant from the cooling medium. The mentioned bearings and tighting elements are not shown in FIG. 2.

The fact, that the cylinder rotates immersed in the surrounding medium, permits, with appropriate form of its surface, the circulation of this medium without additional pumps or blowers. One part of the rotor works like the oil pump, another as the water pump or the blower.

The bolts 10 and 11, the slits 12 and 13 and the grooves 8 and 9 compose the whole mechanism for the conversion of the linear motion of the piston to the rotating motion of the shaft. During this conversion strong forces appear on the inside surfaces of the slits and the grooves. For this reason at these locations I have slide-bearings (as shown in FIG. 2) or roller bearings in order to diminish the friction losses. At each position, I have put two rollers, each in contact with the guide surface.

The linear guide (slits 12 and 13 on FIG. 2) and the curved guide (grooves 8 and 9 on FIG. 2) can also be constructed as guide-tracks. In this case the bearings move on the outer side of the part, and these surfaces can easily be made, hardened and polished.

The mechanism "bolt, linear guide, curved guide" can also be realized with the linear guide on the outer stationary part and the curved guide grooved on to the cylinder which is divided into two independent parts. In that case the piston has no rotating motion and the different parts of the cylinder are held in place by the axial bearings.

Figure 2A:
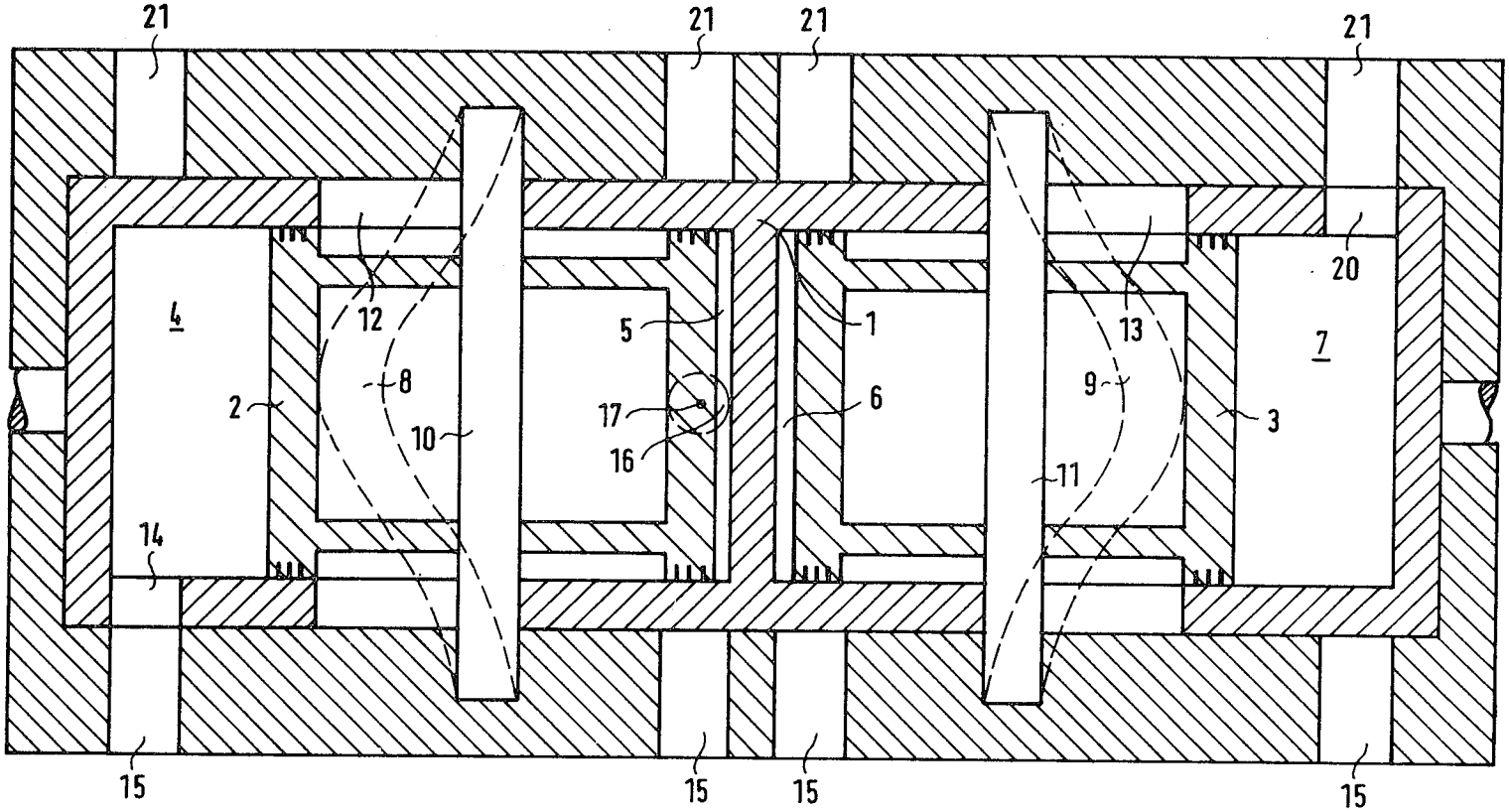
FIGS. 2*a* and 2*b* show in cross-section an internal-combustion engine with four chambers in a common cylinder which at the same time is the axle of the machine.
Figure 2B:
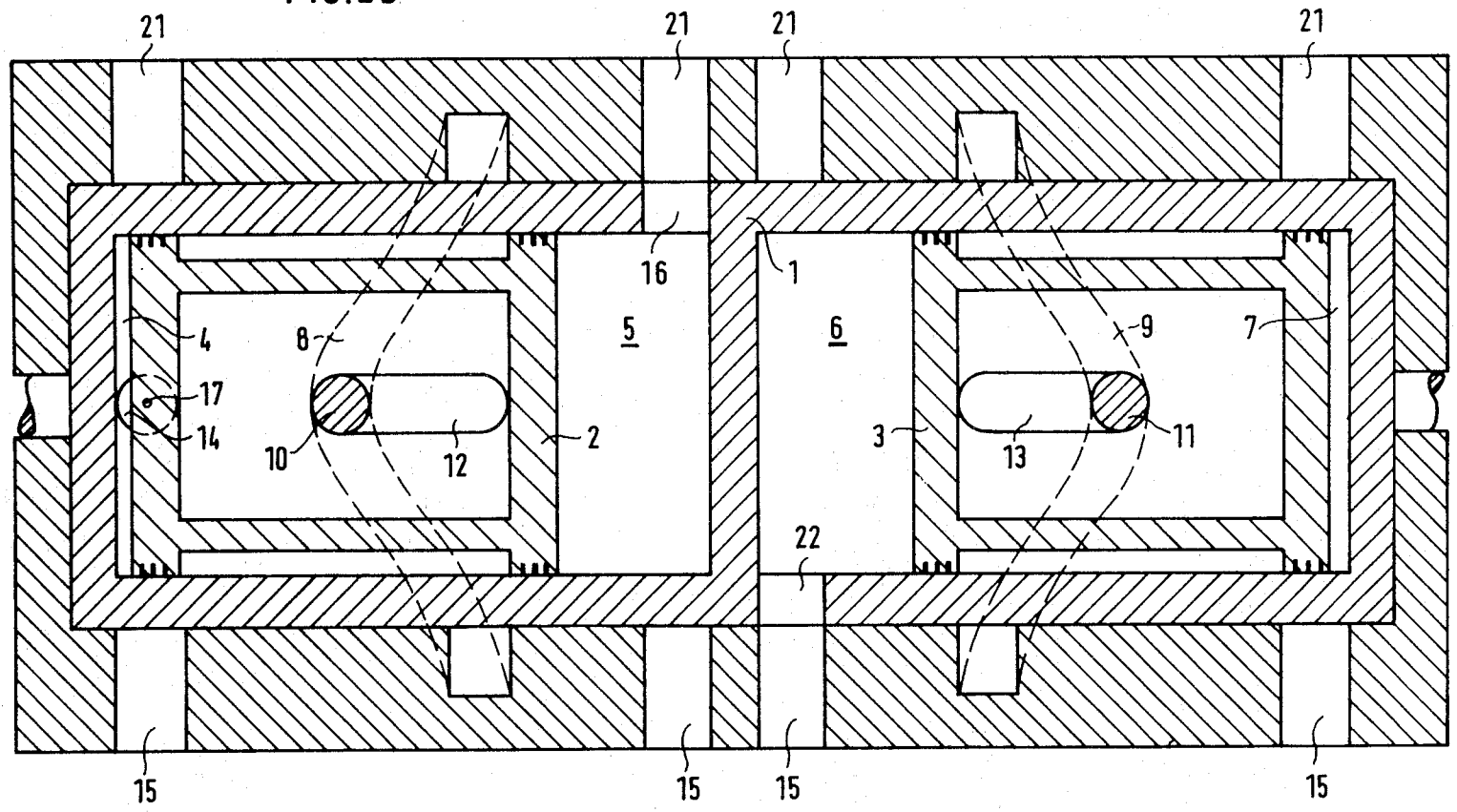

The two parts of the FIG. 2 show the machine at two different phases during its operation. In FIG. 2*b* the cylinder is rotated 90° with regard to FIG. 2*a*. The pistons which in FIG. 2*a* are in the one end of their course, have now reached the other one. The motion of the pistons is absolutely symmetrical so that no vibrations are caused from the periodical acceleration of masses. During one rotation of the cylinder wall the pistons run four times over their course, so that this machine is a "four cylinder"four-stroke engine. Correspondingly four muzzles (14, 16, 20, 22) are provided in such positions so that each chamber is in another phase of the four-stroke cycle.

The openings (muzzles) of the chamber can be round (as shown in FIG. 2) or elongated with their smaller dimension parallel to the rotor axis. That gives the advantage to shorten the whole length of the machine.

In FIG. 2*a* in chamber 4 the opening 14 leaves the inlet channel 15; the compression begins. In chamber 5 the opening is in front of the spark plug; expansion begins. In chamber 6 begins the intake. In chamber 7 begins the exhaust, the opening 20 faces the outlet channel 21. In FIG. 2*b* the muzzle of the chamber 4 faces the spark plug. In chamber 5 begins the exhaust, in chamber 6 the compression, in chamber 7 the intake.

A combustion engine is in reality a chemical reactor with variable volume. The change of its volume is used to produce mechanical work. Therefore the optimization of its function (complete combustion, minimization of harmful exhaust gases and higher efficiency) can only be obtained if the time-law of this volume change is adapted to the needs of the thermodynamics and the reaction kinetics. In the common piston motor however, this time-law is imposed from the crankshaft mechanism as a sine motion. It is easy to show that this time-law is not suitable even for the acceleration of the masses. A motion in accordance with the square of the time gives the same piston velocities with much smaller forces.

The use of the curved guide in this example allows the application of the appropriate time-law, which in addition offers a higher efficiency than the sine-law. If otherwise the maximum efficiency is pursued, the curved guide can produce motions with time dependency of higher order or exponential, which are better adapted to the needs of thermodynamics and chemical kinetics.

The use of the curved guide must not necessarily be limited to a four-stroke engine. The machine can have two or six or generally any desired number of strokes. Furthermore through the use of the curved guide it is possible, that each stroke has another duration or another length than the other.

The machine shown in FIG. 2 has a lot of advantages. The most important are:

1. Unusual economy of total volume and material. As shown in FIG. 2 the total volume of the machine is only about eight times larger than the useful working space of the chambers.

2. Unusual simplicity of the construction and therefore reduction of the production cost and repair cost. The whole "four cylinder" engine consists of four pieces easy to construct, namely the stationary part, the rotor and the two double pistons with their bolts.

3. Unusual diminution of the friction losses. On the pistons appear only axial forces. In the places where friction occurs (linear guides, curved guides), it can be reduced through the use of ball bearings.

4. Unusual possibility to fit the time-law of the volume change in the chambers according to the needs of thermodynamics and chemical kinetics. Therefore better efficiency, fuel economy and less harmful exhaust gasses.

The machine in FIG. 2 shows a high relation of its length to its diameter because four chambers are placed one behind another. If it is desired to reduce the length of the machine, or to have only two chambers, it is not appropriate to "cut" simply the machine in the middle and to use only one double piston, because the accelerating forces are no longer compensated. Care must be taken that always two equal masses have an opposite motion.

Figure 3:
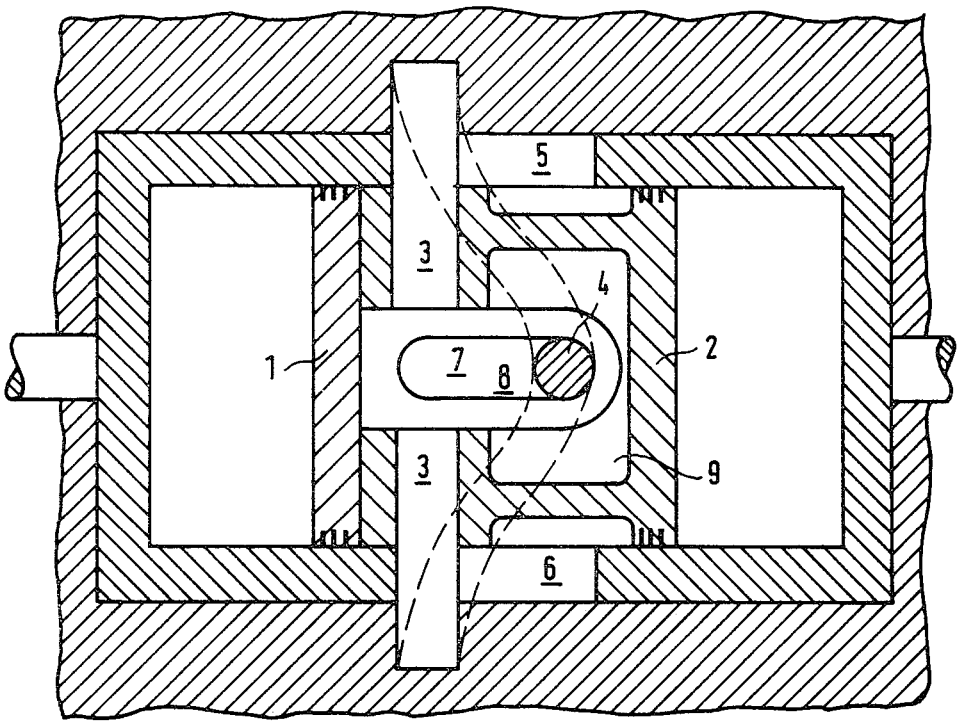
FIG. 3 shows such a "two cylinder" engine in cross-section in accordance with the present invention.

FIG. 3 shows such a "two cylinder" engine. The pistons 1 and 2 have an opposite motion because their bolts 3 and 4 have an angle of 90°. Both bolts are divided in two parts and the cylinder wall has four slits 5, 6, 7, 8 as linear guides for the bolts. The machine has only one curved guide and possesses the advantage to offer between the pistons an additional working space 9. This space is unsuitable as a combustion chamber, but can be used for other purposes (e.g. as compressor).

Figure 4:
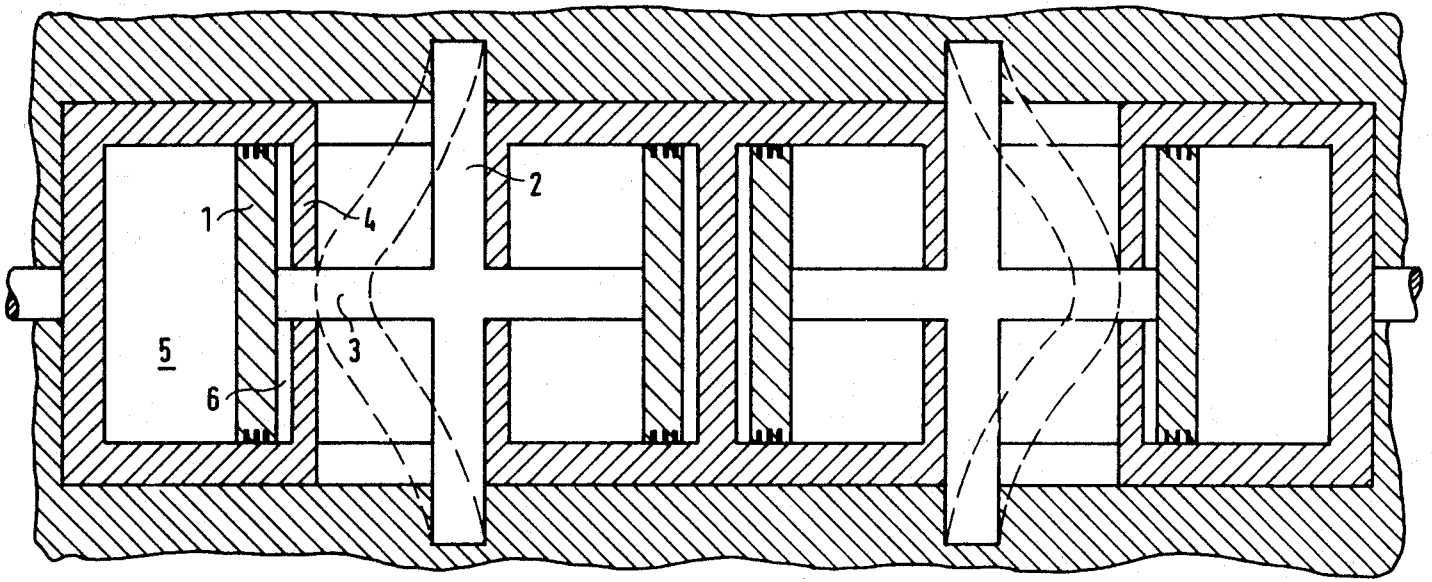
FIG. 4 shows a machine in cross-section in accordance with the present invention plate connected with the bolt through a spindle.

FIG. 4 shows a machine in which the height of the piston is reduced to a plate 1 connected with the bolt 2 through the spindle 3. On the cylinder wall is fixed the separating wall 4. The spindle penetrates the wall through a hole. Sealing rings in the inside of this hole seal the spindle during its stroke movement through the wall. In this manner is created next to the primary chamber 5 a secondary chamber 6 with approximately (except for the volume occupied by the spindle) an equal useful working space.

The secondary working space can be used as a new independent combustion chamber, or can work in cooperation with the principal chamber for the compression of the air or the expansion of the exhaust gases.

Without a notable change of its total volume the machine of FIG. 4 has the double working volume as the machine of FIG. 2. The machine in FIG. 4 with solely two oscillating parts is an "eight cylinder" engine, in which the total volume is only about four times larger than the working volume.

As shown in FIG. 2, 3 and 4 machines built in accordance to this example possess a cylindrical outer form and have (like electric motors) all their moving parts symmetrically arranged around their rotating axis, so that they are particularly suitable for purposes (e.g. airplane motors) where a miniumum of vibration is desired.

EXAMPLE 2

Figure 5:
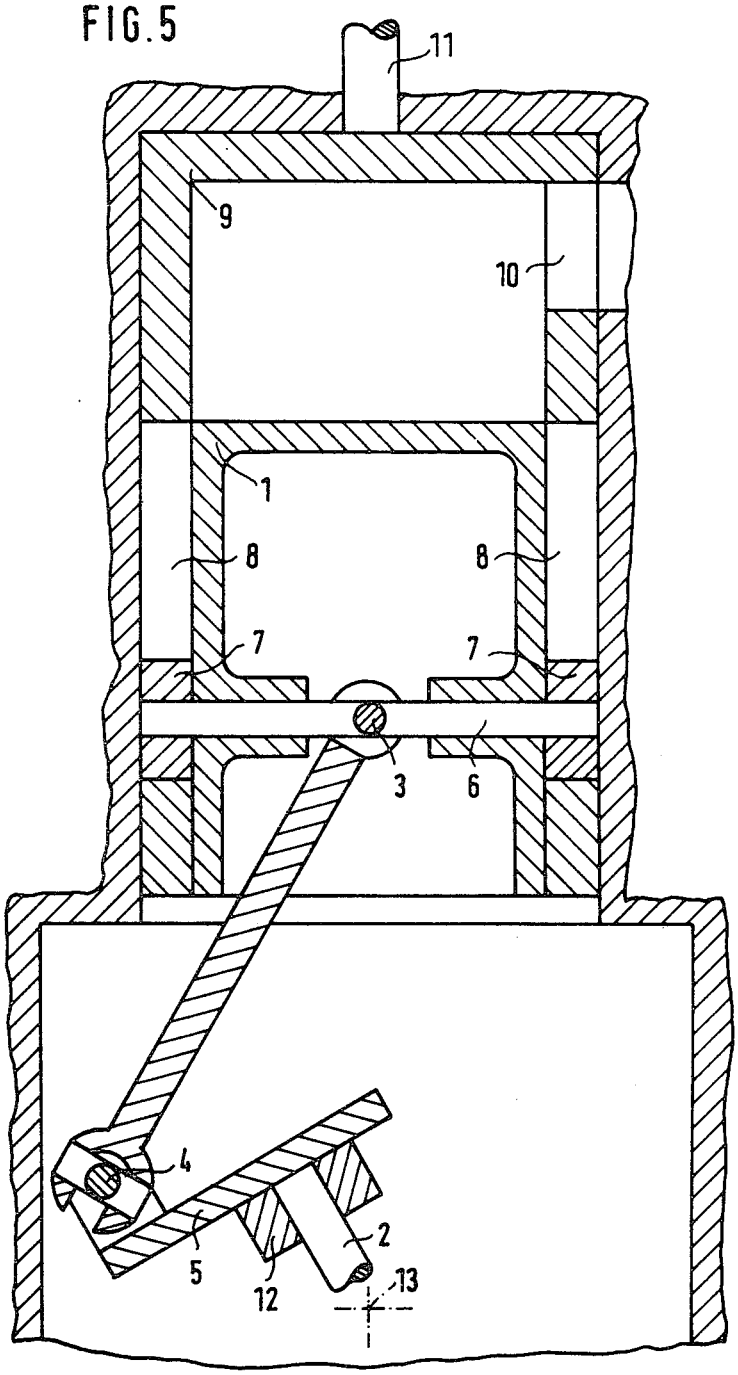
FIG. 5 shows a machine in cross-section in accordance with the present invention in which the stroke movement of the piston is effected from a crank through universal joints.

FIG. 5 shows a machine in which the stroke movement of the piston 1 is caused from the crank 5 through the universal joints 3 and 4. At the same time the piston rotates round its axis and this rotation is carried to the cylinder wall 9 via the bolt 6, the rolls 7 and the slits 8. The aperture 10 regulates the inlet and outlet of the working fluid. Mechanical energy can be given to the machine or (if it is a motor) be taken from it away through both axles 2 and 11.

The important point of this construction is that the length of the piston's stroke and consequently the power of the machine depends on the relative place of the axes 2 and 11. Both axes lie on the same plane (which is the cross sectional plane in FIG. 5), but they can have different angles to each other. If both axes lie on the same straight line, the stroke movement of the piston disappears (piston and cylinder wall rotate without volume change). If they are displaced from the straight line, the stroke movement appears and augments when the angle between the axes increases.

In FIG. 5 the axes 2 and 11 are shown in the position which cause the maximum stroke length. If the bearing 12 is turned round the axis 13 (which stays perpendicular to the plane of FIG. 5), the stroke becomes shorter until it disappears when the axes 2 and 11 are on a straight line. If the bearing 22 is turned further, the stroke appears again but with a phase difference of 180°. Depending on the use of the machine this change serves to reverse either the flow direction of the working fluid (e.g. in a circulation pump), or the rotating direction of the machine (e.g. in a compressed air motor).

The motion transfer from shaft 2 to the axle 11 via the bolt 6 and the slits 8, permit the realization only of the two-stroke principle. One revolution corresponds to two strokes. That makes the machine suitable for such uses as for example pumps, compressors, hydraulic motors etc. However this motion transfer can be fulfiled also externaly through common elements (shafts, gears, chains etc). In such a case the bolt 6 does not extend outside of the piston walls, the slits 8 do not exist and the piston can have another rotation speed as the cylinder wall. Thus realizing the four-stroke (or any desired) principle.

The change of the position of the bearing 12 can easily be made possible also if the machine is in full operation, so that such a machine can continuously change its power, even reverse its working direction, during the operation and independent of the rotation speed. These characteristics constitute advantages of great importance for several applications: e.g. injection pumps, vessels, or vehicles relieved from a gear box.

The invention is further illustrated with reference to FIGS. 6 to 10 which show preferred embodiments of the present invention. It is to be understood, however that the invention is not limited to these preferred embodiments.

Figure 6B:
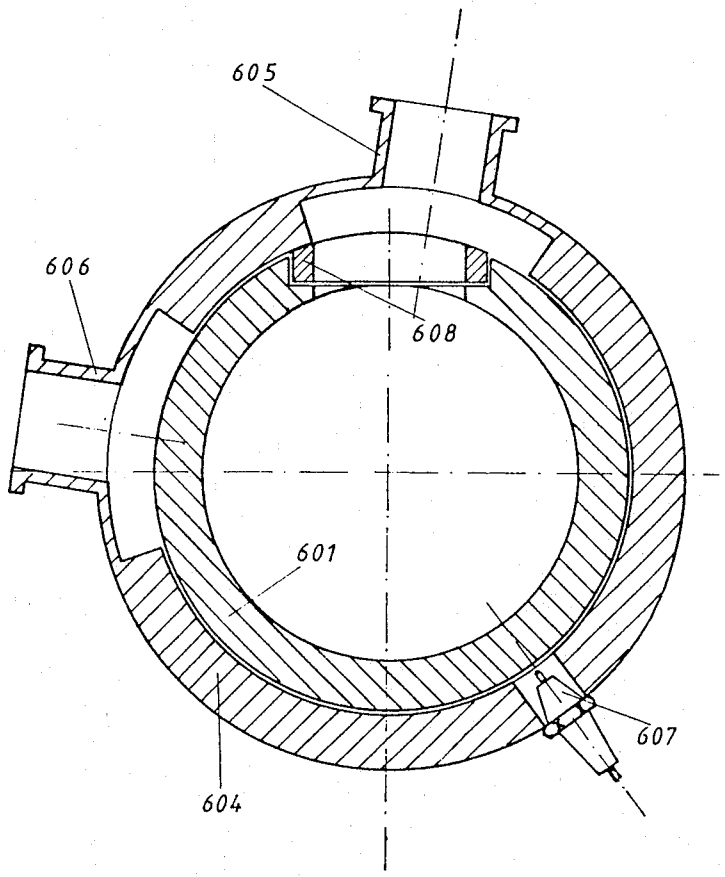
FIG. 6*b* is a cross-sectional view taken along line b—b of FIG. 6*a;*
Figure 6A:
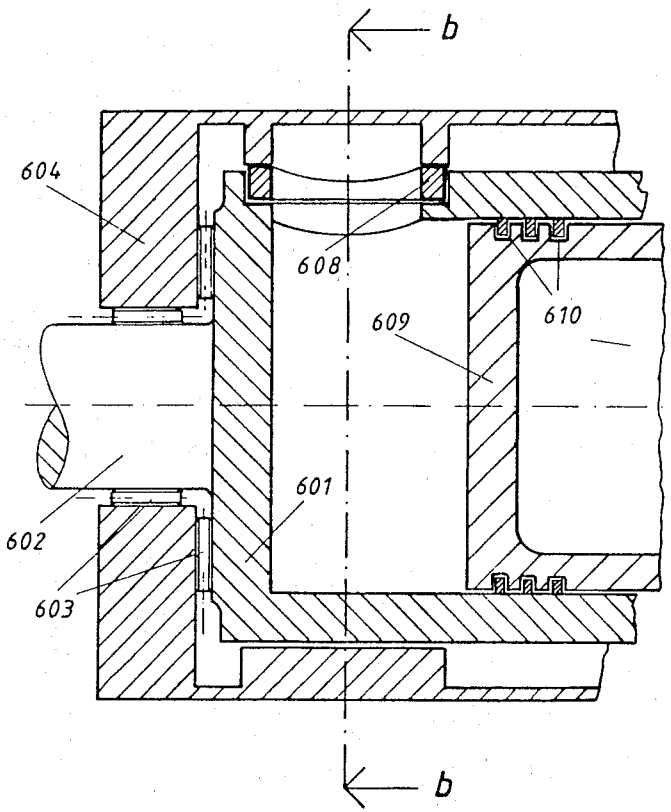
FIG. 6*a* depicts an axial cross-section through an embodiment of a machine according to the present invention. In particular, it shows the sealing members by which the rotating cylinder is sealed against the stationary member.

FIG. 6*a* is an axial cross-section through an embodiment of the machine according to the present invention. In particular, it shows the sealing members by which the rotating cylinder is sealed against the stationary member.

Rotating cylinder or rotor 601 is supported by axis 602 which also rotates in a bearing which is indicated by rollers 603. The bearing is positioned in a stationary member 604.

As shown in FIG. 6*b* (which is a section along the line b—b of FIG. 6*a*), stationary member 604 includes means for introducing fluid 605 and means for discharging fluid 606. It also includes means for igniting an ignitable fluid, such as gasoline, in the form of a spark plug 607.

Rotor 601 carries sealing ring 608 which is inserted in its cylindrical wall portion and is designed to alternately overlie the means for introducing and discharging fluid (605 and 606), respectively.

Moving rotatingly and axially with rotor 601 is a piston 609 which is sealed against rotor 601 by means of usual sealing gaskets 610.

Figures 7A, 7B, 7C:
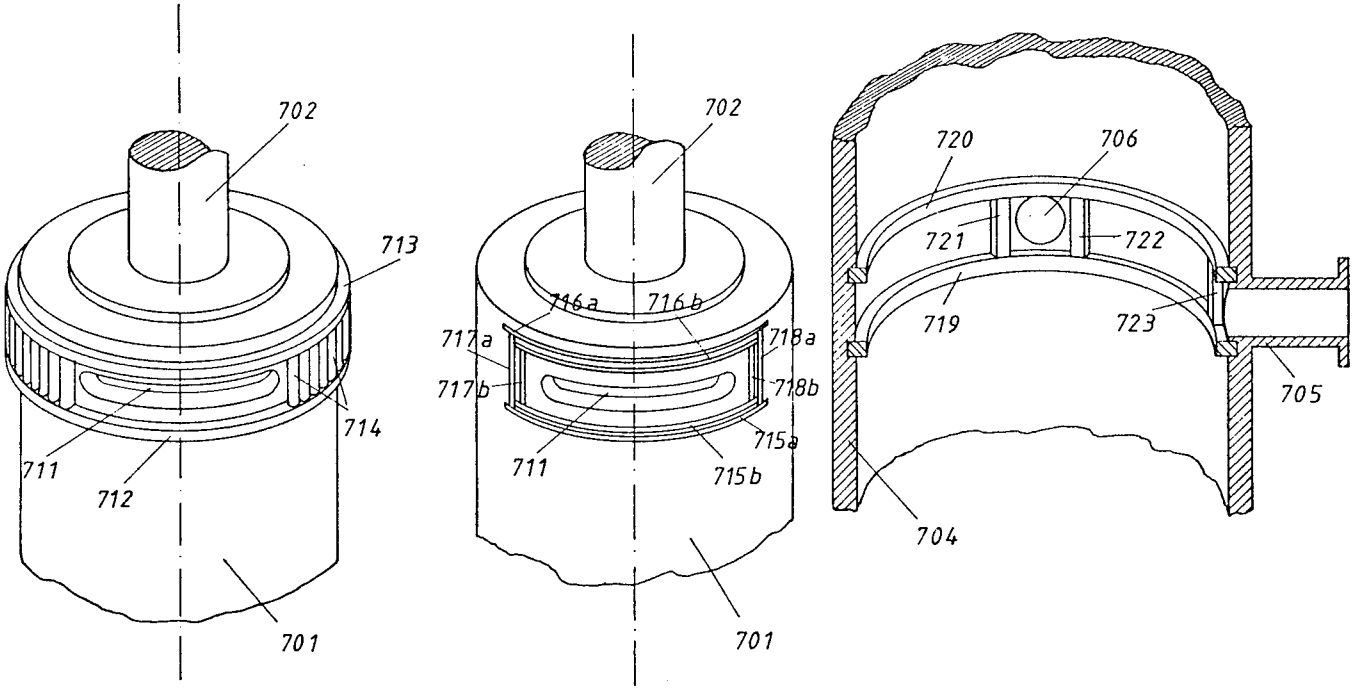
FIGS. 7*a*, 7*b* and 7*c* show three alternatives of how a rotating cylinder or rotor which is supported by axis may be sealed against a stationary member.

FIGS. 7*a*, 7*b* and 7*c* show three alternatives of how a rotating cylinder or rotor 701 which is supported by axis 702 may be sealed against stationary member 704.

FIG. 7*a* shows an elongated opening 711 which is sealed by rings 712 and 713 which are concentric to the cylinder axis 702 and are inserted in the cylindrical wall of rotor 701. The space between rings 712 and 713 is sealed by means of rollers 714.

FIG. 7*b* also shows an elongated opening 711 which is designed to overlie each of the means for introducing and discharging fluid, and which is sealed by arcuate sealing members 715*a* and *b* and 716*a* and *b* which are concentric around axis 702 and are inserted in grooves within the cylindrical walls of rotor 701. Between sealing members 715*a*, 715*b* and 716*a*, 716*b*, there are sealing sticks 717*a* and *b* and 718*a* and *b* which are parallel to axis 702.

FIG. 7*c* shows sealing elements 719 and 720 inserted in grooves within the inner cylindrical wall surface of stationary member 704. Sealing elements 719 and 720 are peripheral rings which are concentric to the longitudinal axis of stationary member 704. There are also sealing sticks 721 and 722 displaced in grooves within the cylindrical wall of stationary member 704 and around opening 706 of the means for discharging fluid (not shown). Similar sealing sticks 723 are displaced around the means for introducing fluid 705.

Figure 8B:
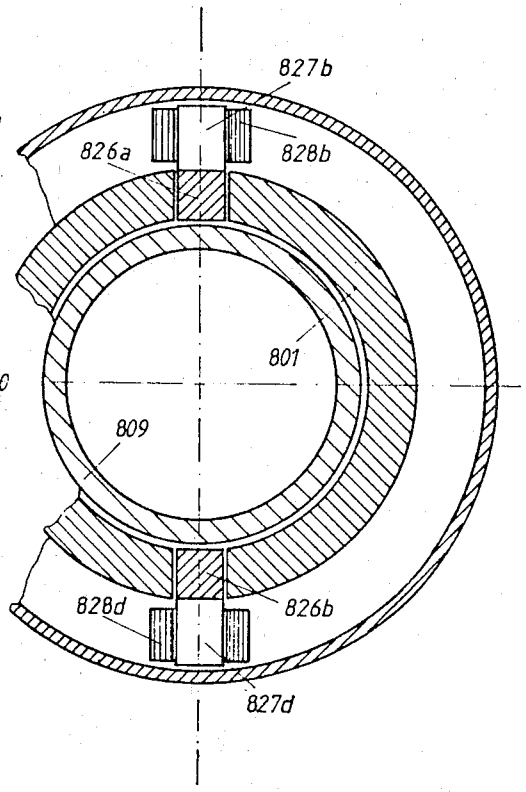
FIG. 8*b* is a cross-section along the line b—b of FIG. 8*a;*
Figure 8A:
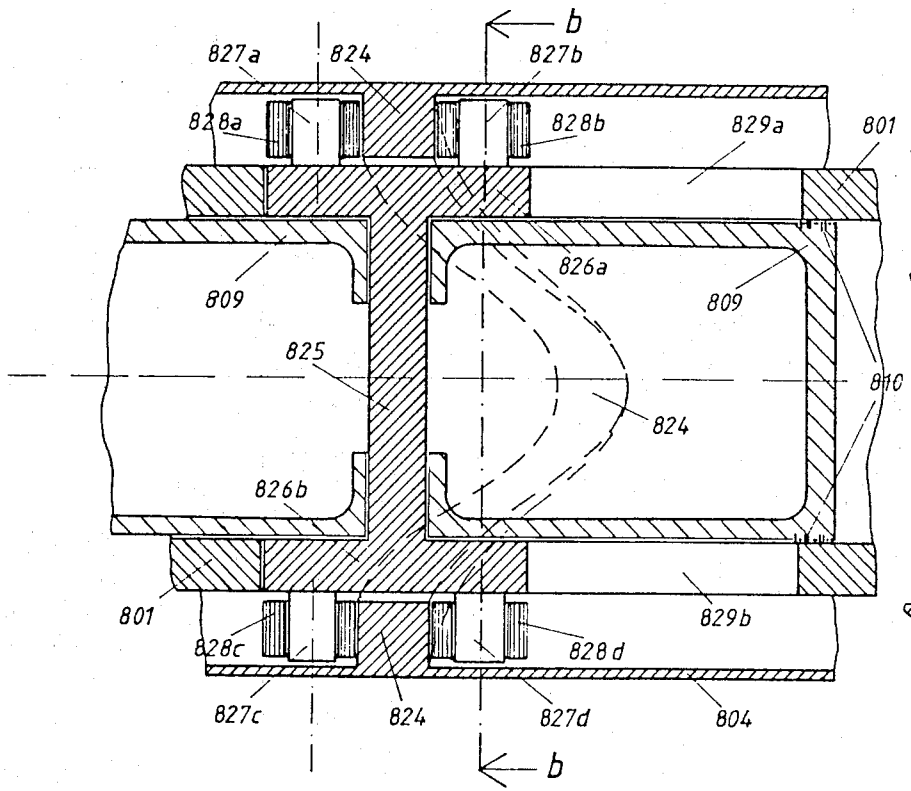
FIG. 8*a* is a partial cross-section along the axis of another embodiment of a machine according to the present invention.

FIG. 8*a* is a partial cross-section along the axis of another embodiment of the machine according to the invention. FIG. 8*b* is a cross-section along the line b—b of FIG. 8*a*. *FIGS.* 8*a* and 8*b* show the guide means 824 for converting the linear motion of piston 809 into the rotating motion of the piston-and-cylinder assembly. Piston 809 performs a reciprocating movement in rotating cylinder or rotor 801 which rotates relative to stationary member 804. Stationary member 804 has a curved guide 824 disposed around cylinder 801. The shape of the curved guide 824 protruding from the inner wall of stationary member 804 is indicated by the dotted lines in FIG. 8*a*. Piston 809 is supported by a double-T-shaped member 825 passing through rotor 801. The T-beams 826*a* and 826*b* of the double-T-shaped member 825 support axes 827*a* to *d* which carry rollers 828*a* to *d* to engage the curved guide 824. The T-beams 826*a* and *b*, upon reciprocating movement of the piston 809, slide within the elongated linear guides 829*a* and *b*, respectively, which are cut into the walls of cylinder 801. Piston 809 is sealed towards the working chamber by means of sealing gaskets 810.

Figure 9B:
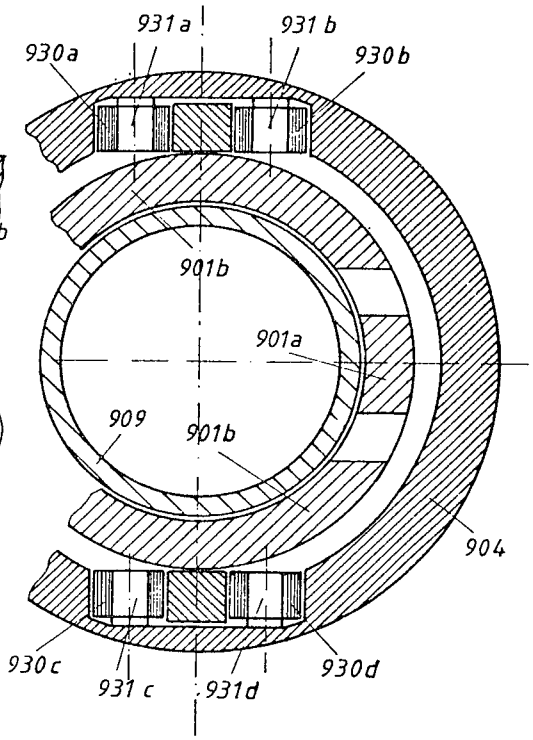
FIGS. 9*a* and 9*b* show an embodiment similar to that of FIGS. 8*a* and 8*b.*
Figure 9A:
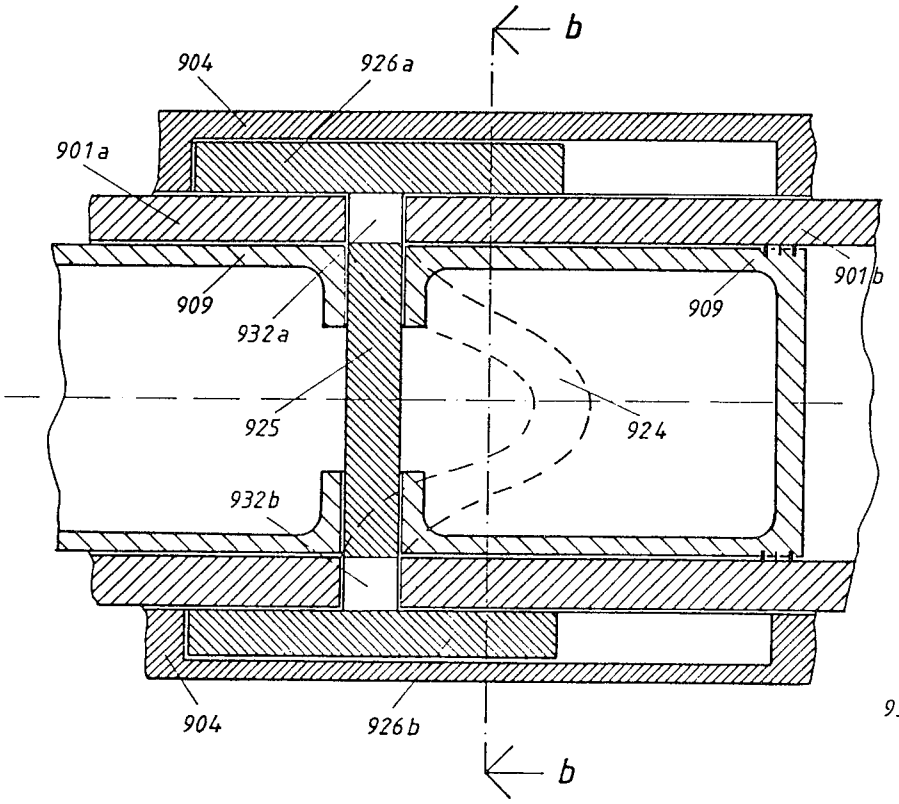

FIGS. 9*a* and 9*b* show an embodiment similar to that of FIGS. 8*a* and 8*b* (FIG. 9*b* being a cross-section along the line b—b of FIG. 9*a*) wherein the stationary member 904 has a linear guide disposed therein. The linear guide is formed by rollers 930*a* to *d* which are supported by axes 931*a* to *d* supported by stationary member 904. Rollers 930 engage T-beams 926*a* and *b* of double-T-shaped member 925 which support piston 909. The rotating cylinder or rotor consists of two independent parts 901*a* and 901*b* whose cylinder walls define curved guide 924. The neck portions 923*a* and *b* of double-T-member 925 slide within curved guide 924 which is indicated by a dotted line.

Figure 10:
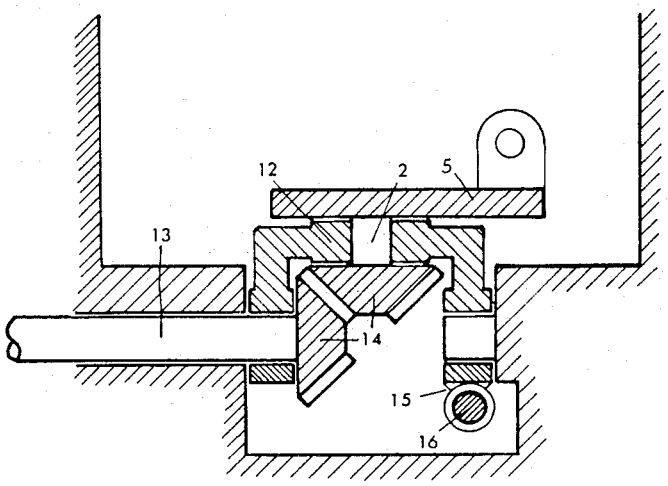
FIG. 10 is a cross-section view through axis 13 of FIG. 5 and shows a support for the crank depicted in FIG. 5.

FIG. 10 is a cross-section through axis 13 of FIG. 5 and shows a support for crank 5 of FIG. 5. It shows how the relative angular position of bearing 12 relative to the axis of rotating cylinder 9 of FIG. 5 can be varied. The gear 14 transmits rotation of axis 2 to axis 13. Bearing 12 which has to stand large forces is secured against unintended tilting by means of a worm gear drive 15, 16. Turning worm 16 will change the angle between axis 2 and the cylinder axis, whereby the output and direction of rotation of the machine may be varied continuously.

What is claimed is:

1. A machine comprising two pistons of equal masses, a single cylinder having openings on its surface, a stationary member surrounding said cylinder, means provided in said stationary member for introducing a fluid into two cylindrical working chambers defined by said pistons and opposite terminal walls of said cylinder, means provided in said stationary member for discharging a fluid from said working chambers, wherein said cylinder rotates upon movement of said pistons whereby to allow fluid to enter or leave said working chambers or to be retained therein depending upon the extent of rotation, and wherein said openings are in periodic registry with said means for introducing or discharging fluid whereby to allow fluid to enter or leave said working chambers depending upon the extent of rotation, wherein said stationary member has a single curved guide disposed about said cylinder, said cylinder having four linear guides in its wall, each being set apart 90°, two opposed linear guides being engaged by a portion of one piston, and two other opposed linear guides being engaged by a portion of the other, said piston portions being set 90° apart, whereby rotation of said cylinder about its longitudinal axis causes said pistons to rotate about and simultaneously perform symmetrical opposite linear movements along their longitudinal axis.

2. A machine according to claim 1, wherein said linear guides are engaged by a roller member of said piston.

3. A machine according to claim 1, wherein said cylinder comprises for each of said openings at least one sealing member designed to seal each of said openings on the cylinder surface against said stationary member.

4. A machine according to claim 1, wherein said means for introducing a fluid is a means for introducing an ignitable fluid.

5. A machine according to claim 4, wherein said machine comprises means for igniting said ignitable fluid.

* * * * *